US005234366A

United States Patent [19]

Van Dartel et al.

[11] Patent Number: 5,234,366

[45] Date of Patent: Aug. 10, 1993

[54] METHOD OF MANUFACTURING A CATHODE RAY TUBE

[75] Inventors: Nicolaas H. P. Van Dartel; Johannes W. H. Verhagen, both of Eindhoven, Netherlands

[73] Assignee: U.S. Philips Corporation, New York, N.Y.

[21] Appl. No.: 675,225

[22] Filed: Mar. 26, 1991

[30] Foreign Application Priority Data

Mar. 26, 1990 [NL] Netherlands ..... 9000703

[51] Int. Cl.[5] ..... H01J 9/02

[52] U.S. Cl. ..... 445/67; 445/34; 29/235

[58] Field of Search ..... 445/34, 67; 29/235, 29/468; 81/486; 65/138, 139

[56] References Cited

U.S. PATENT DOCUMENTS

| | | | |
|---|---|---|---|
| 3,145,464 | 8/1964 | Green | 29/235 |
| 3,381,347 | 5/1968 | Reinwall, Jr. | 445/34 |
| 4,028,797 | 6/1977 | Miller | 29/235 |

FOREIGN PATENT DOCUMENTS

| | | | |
|---|---|---|---|
| 56-7327 | 1/1981 | Japan | 445/34 |
| 58-12238 | 1/1983 | Japan | 445/34 |
| 60-74330 | 4/1985 | Japan . | |

OTHER PUBLICATIONS

D. G. Holloway, *The Physical Properties of Glass*, Wykeham Publications Ltd., London, 1973, pp. 150, 151, 154, 155.

*Primary Examiner*—Kurt C. Rowan
*Assistant Examiner*—Jeffrey T. Knapp
*Attorney, Agent, or Firm*—Paul R. Miller

[57] ABSTRACT

A method of manufacturing a cathode ray tube is provided for comprising a neck portion 4 in which an electron 5 having resilient elements 14 is secured. The method comprises a manufacturing step in which the electron gun 5 is inserted into the neck portion 4 by means of a managing tool 57 which serves to press together the resilient elements 14. Viewed in the axial direction, the managing tool 57 is located outside and clear of the neck portion 4.

2 Claims, 3 Drawing Sheets

METHOD OF MANUFACTURING A CATHODE RAY TUBE

Figure 1:
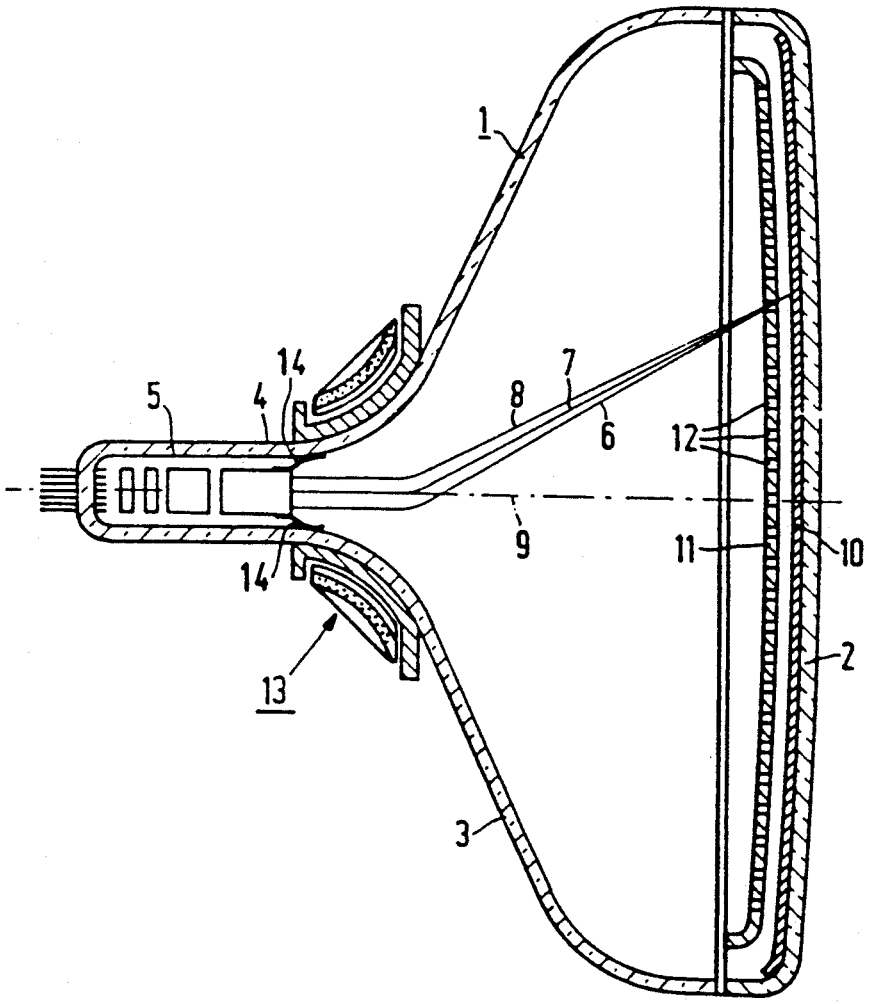

The invention related to a method of manufacturing a cathode ray tube comprising a neck portion having an electron gun which is provided with resilient elements, with this method comprising a manufacturing step in which the electron gun is inserted into the neck portion via a managing tool which is used to press the resilient elements toward each other.

BACKGROUND OF THE INVENTION

A method of the type described in the opening paragraph is known from JP-A-60/74330. In the method described therein, use is made of a (hollow) managing tool comprising a tubular portion and a gradually widening portion. The tubular portion of the managing tool is introduced into the neck portion, after which the electron gun is accommodated in the wide end portion of the managing tool, so that the resilient elements bear against the inner wall of the managing tool. The electron gun is slid through the managing tool into the neck portion. In this operation, the resilient elements are urged towards each other by the shape of the managing tool, as a result of which the electron gun can be more easily inserted into the neck portion and it is preluded that the resilient elements scratch the end portion and the inner wall of the neck, which would cause glass particles to be released.

It has been found, however, that despite the use of these measures, a still significant number of the manufactured cathode ray tubes is rejected. It has also been found that in several finished cathode ray tubes the mutual positioning of the electrodes in the electron gun does not meet the requirements.

SUMMARY OF THE INVENTION

It is an object of the invention to provide, inter alia, a method of manufacturing a cathode ray tube, which method leads to a smaller number of rejects than the known method.

For this purpose, a method of the type describe in the opening paragraph is characterized, according to the invention, in that during the insertion of the electron gun into the neck portion, viewed in the direction of the axis of the neck portion, the managing tool is located solely outside the neck portion and lies clear of the neck portion.

The invention is based on the insight that in the known method the neck portion can be damaged if, during the positioning of the managing tool or during the insertion of the electron gun, the managing tool strikes the neck portion. By virtue of the fact that the managing tool according to the invention is positioned solely outside the neck portion and lies clear of the neck portion, the occurrence of damage to the neck involving the release of glass particles is precluded.

A preferred embodiment of the method according to the invention is characterized in that the managing tool used comprises an at least partly conical portion. By virtue thereof, the resilient elements are pressed towards each other in a simple manner when the electron gun is slid through the conical portion. This permits the electron gun to be more readily inserted into the neck portion.

A further preferred embodiment of a method according to the invention is characterized in that prior to inserting the electron gun into the neck portion, the axis of the managing tool is brought substantially in line with the axis of the neck portion. When the axis of the managing tool is insufficiently aligned relative to the axis of the neck portion, the electron gun is obliquely inserted into the neck portion, so that the part of the neck portion which is struck by the electron gun or the resilient elements of the electron gun is subject to a larger force than other parts of the neck portion. Apart from causing local damage to the neck, the force acting on the electron gun may also adversely affect the mutual positioning of the electrodes of the electron gun and, hence, disturb the operation of the electron gun.

When the axis of the managing tool is brought in line with the axis of the neck portion, the electron gun can be inserted into the neck portion without generating undesired forces. By virtue hereof, damage to the neck portion or disturbance of the mutual positioning of the electrodes is largely precluded.

Preferably, the neck portion used has a cylindrical shape and can be manufactured in an accurate and cost-effective manner.

BRIEF DESCRIPTION OF THE DRAWING FIGURES

Figure 2:
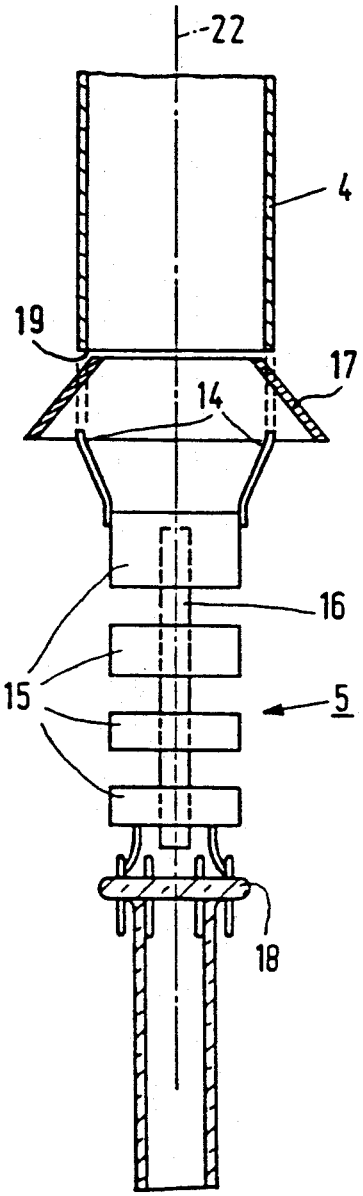
Figure 3:
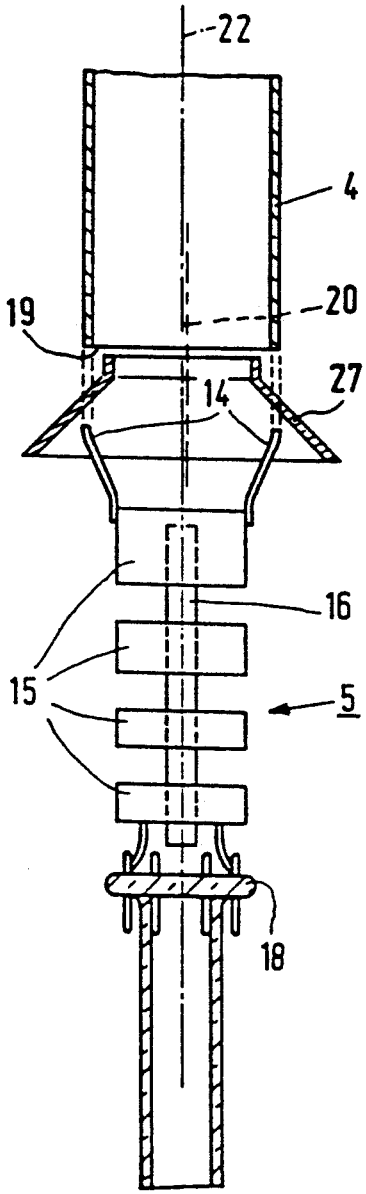
Figure 4:
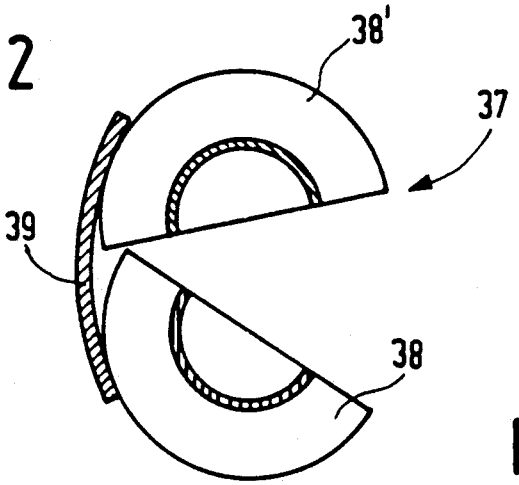
Figure 5:
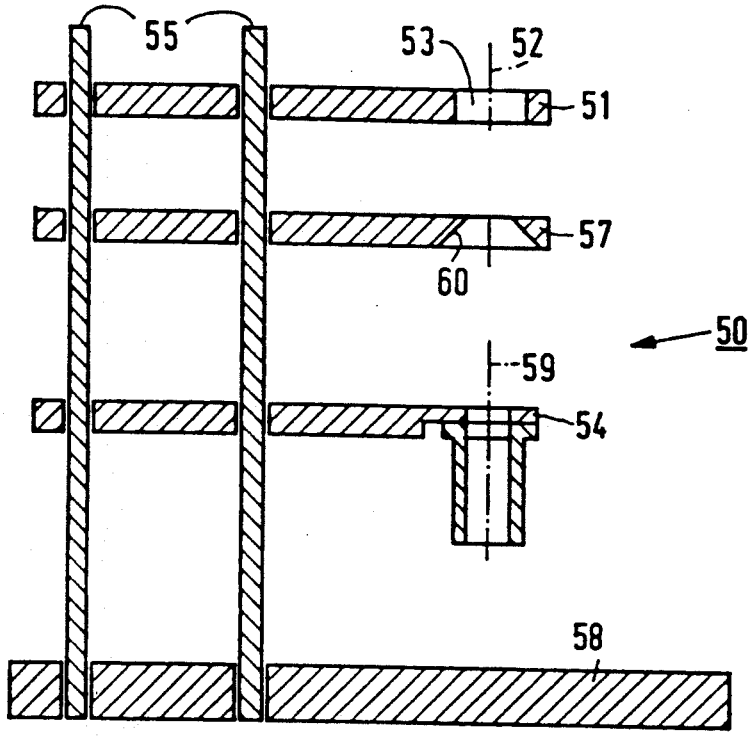
Figure 6:
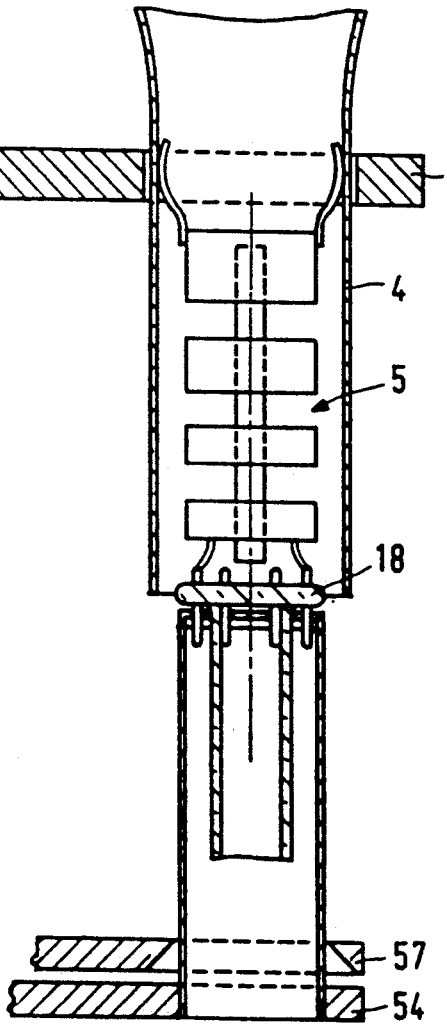

Several embodiments of a method according to the invention and a device according to the invention will be described in greater detail with reference to the accompanying drawing, in which FIG. 1 is a diagrammatic longitudinal sectional view of a cathode ray tube, FIG. 2 is a diagrammatic sectional view of a stage of a method for the manufacture of a cathode ray tube according to the invention, FIG. 3 is a diagrammatic sectional view of a stage of an alternative method of manufacturing a cathode ray tube according to the invention, FIG. 4 is a diagrammatic sectional view of a two-part managing tool, and FIGS. 5 and 6 are diagrammatic sectional views of at least a part of a device which is suitable for carrying out the method according to the invention.

DESCRIPTION OF THE INVENTION

The cathode ray tube shown in FIG. 1 is a colour display tube of the "in-line" type. An electron gun 5 is arranged in the neck portion of a glass envelope 1 which is composed of a display window 2, a cone 3 and a neck portion 4, with the electron gun generating three electron beams 6, 7 and 8 whose axes are coplanar before they are deflected. The axis of the central electron beam 7 coincides with the tube axis 9. The electron gun 5 is centered in the neck portion 4 by means of resilient elements 14. The inside of the display window 2 is provided with a large number of triads of phosphor elements. These elements may consist of lines or dots. Each triad contains an element consisting of a phosphor luminescing in blue, an element consisting of a phosphor luminescing in green, and an element consisting of a phosphor luminescing in red. All triads together form the display screen 10. The phosphor lines extend substantially perpendicularly to the plane of the beam axes. In front of the display screen 2, there is positioned a shadow mask 11 in which a large number of apertures 12 is formed through which the electron beams 6, 7 and 8 pass.

The electron beams 6, 7 and 8 are deflected horizontally (in the plane of the drawing) and vertically (perpendicularly to the plane of the drawing) by a deflection coil system 13. The three electron guns are mounted such that their axes enclose a small angle. As a result thereof, the generated electron beams 6, 7 and 8 pass through the apertures 12 at this angle, the so-called colour selection angle, and each beam impinges only on phosphor elements of one colour.

In a process step in the manufacture of the display tube, the electron gun is inserted into the neck portion 4 having a central axis 22. FIG. 2 is a diagrammatic representation, according to an embodiment of the invention, of the situation before the electron gun 5 is inserted into the neck portion 4. The electron gun 5 comprises a number of electrodes 15 which are interconnected by means of a number of rods 16 of insulating material. The electron gun 5 is mounted on a glass plate 18, also termed base plate. Since the resilient elements 14 have to exert a certain pressure on the inner wall of the neck portion when the electron gun is accommodated in the neck portion 4, the distance, in the unloaded condition, between the free ends of the resilient elements 14 is larger than the inside diameter of the neck portion 4 at the location where the resilient elements 14 bear against the inner wall.

Prior to inserting the electron gun 5 into the neck portion 4, it is ensured that the resilient elements 14 are pressed together and that the electron gun 5 can be readily inserted into the neck portion, thus precluding undesired damage to the end portion 19 of the neck portion 4, by pressing the resilient elements 14 towards each other by means of a managing tool. The compression of the resilient elements 14 can be carried out, for example, by selecting a suitably shaped managing tool through which the electron gun is slid.

According to the invention, the occurrence of damage to the neck is at least substantially overcome in that during the insertion of the electron gun into the neck portion, viewed in the direction of the axis of the neck portion, the managing tool is positioned solely outside the neck portion and lies clear of the neck portion.

In the embodiment shown in FIG. 2, the managing tool 17 is conically shaped. The inside diameter of the managing tool 17 becomes smaller in the direction of the neck portion 4. By positioning the managing tool 17 at a defined distance from the end portion 19 of the neck portion 4, viewed in the direction of axis 22, it is obtained that the managing tool 17 lies clear of the neck portion 4, so that the occurrence of damage to the neck caused by the managing tool 17 striking the neck portion 4 is prevented. In practice, this distance if, for example, 0.2 to 0.5 mm. When the electron gun 5 is slid through the conical managing tool 17, the resilient elements 14 are pressed towards each other as a result of the reduction in inside diameter. In this manner, the resilient elements 14 can be introduced into the neck portion 4 in a simple manner and at least substantially without the occurrence of damage to the neck, after which the electron gun 5 can be inserted further into the neck portion 4. The distance between the narrow end portion of the conical managing tool 17 and the end portion 19 of the neck portion 4 should not be so large that the resilient elements 14 reassume the unloaded condition before they are inside the neck portion 4.

In a further embodiment of a method according to the invention, the managing tool comprises a conically shaped portion and a cylindrically shaped tubular portion extending towards the neck portion. FIG. 3 is a diagrammatic sectional view of such a managing tool 27. Viewed in the direction of the axis of the neck portion, the tubular portion is located solely outside the neck portion 4 and lies clear of the neck portion 4. To facilitate the insertion of the electron gun, the largest outside diameter of the tubular portion is, for example, smaller than the smallest inside diameter of the neck portion 4. When the axis 20 of the managing tool 27 extends substantially in line with the axis 22 of the neck portion 4, it can be prevented that the managing tool 27 undesirably bears against the neck portion 4 after it has been inserted into said neck portion 4, and, in addition, the electron gun 5 can be so inserted into the neck portion 4 that it is in line therewith. A managing tool comprising a cylindrical portion is very suitable for aligning the electron gun with the neck portion.

By inserting the electron gun into the neck portion in such a manner that they are in line with each other, it is precluded that when the resilient elements come to bear against the inner wall of the neck portion, undesirably large forces are exerted on the neck portion, which could lead to damage to the neck.

The managing tool 37 may also comprise two halves 38 and 38' which can be mated (see the diagrammatic sectional view of FIG. 4). A partly cylindrical spring 39 keeps the two halves 38 and 38' together.

FIG. 5 is a diagrammatic sectional view of a device 50 which is suitable for carrying out a method according to the invention. The device 50 comprises a supporting mechanism 51 in which an aperture 53 is formed. A neck portion of a cathode ray tube can be placed in the aperture 53, so that the axis of the neck portion substantially coincides with the central axis 52 of the aperture 53. The device further comprises an inserting mechanism 54 on which an electron gun having resilient elements can be placed so that the axis of the electron gun substantially coincides with the axis 59 of the inserting mechanism. The inserting mechanism 54 can be moved relative to the supporting mechanism 51 by means of guide rods 55. The device further comprises a plate 57 which can be moved relative to the supporting mechanism 51 by means of the guide rods 55. A conical recess 60 in the plate 57 forms the managing tool. The assembly is mounted on a supporting plate 58 and positioned such that when the parts 51, 54 and 57 are moved along the guide rods the axis of the conical recess 60 in the plate 57, the central axis 52 and the axis 59 of the inserting mechanism 54 remain substantially in line. The insertion of an electron gun arranged on the inserting mechanism 54 into a neck portion placed on the supporting mechanism 51 takes place as follows. The plate 57 with the managing tool is moved to a defined distance from the supporting mechanism 54 by means of the guide rods 55, the plate 57 lying clear of the neck portion. The inside diameter of the conical recess 60 is smaller than the distance between the free ends of the resilient elements in the unloaded condition, so that the resilient elements of the electron gun are compressed by the conical recess. By providing the device with suitable means, it is ensured that the managing tool lies clear of the neck portion when the electron gun is inserted into the neck portion. This can be achieved, for example, by means comprising stops on the guide rods which limit the movement of the mechanisms and the managing tool relative to each other or by suitably dimensioning the mechanisms and the managing tool.

When the electron gun is led through the managing tool to the supporting mechanism 51, the resilient elements are pressed together and the electron gun can be readily inserted into the neck portion. By suitably dimensioning the parts of the device, the plate 57 can be brought to a distance from the neck portion 4, such that the base plate 18 of the electron gun 5 lies clear when the managing tool 57 is removed from the neck portion 4 (as shown in the diagrammatic, sectional view of FIG. 6). By virtue thereof, the electron gun 5 can be secured in the neck portion 4 by sliding the electron gun 5 further into the neck portion 4 and fusing together the base plate 18 and the neck portion 4.

In the above embodiments, the invention is described by means of a managing tool which comprises an at least partly conical portion. However, the invention is not limited thereto. A tubular managing tool having two halves can alternatively be used. Further, the invention is described by means of a method of manufacturing a colour display tube. It will be obvious, however, that the invention also relates to a method of manufacturing other cathode ray tubes such as, for example, an oscilloscope or projection display tube.

We claim:

1. A mechanism for inserting an electron gun in to a neck portion of a cathode ray tube comprising:

a) first means for holding a cathode ray tube with a neck portion extended, b) second means for holding an electron gun assembly axially aligned with said neck portion, c) third means for guiding said electron gun assembly into said neck portion, said third means being axially aligned with said neck portion, d) fourth means for relatively moving said second and third means with respect to each other and with respect to said first means, and e) fifth means for limiting movement of said third means to a given distance from said neck portion.

2. A mechanism according to claim 1, wherein said given distance ranges from approximately 0.2 to 0.5 mm.

* * * * *